US005403971A

United States Patent [19]

Aoki

[11] Patent Number: 5,403,971

[45] Date of Patent: Apr. 4, 1995

[54] ELECTRONIC MUSICAL INSTRUMENT WITH PORTAMENTO FUNCTION

[75] Inventor: Eiichiro Aoki, Hamamatsu, Japan

[73] Assignee: Yamaha Corpoation, Hamamatsu, Japan

[21] Appl. No.: 42,895

[22] Filed: Apr. 5, 1993

Related U.S. Application Data

[63] Continuation of Ser. No. 657,158, Feb. 15, 1991, abandoned.

[30] Foreign Application Priority Data

Feb. 15, 1990 [JP] Japan ..... 2-032487

[51] Int. Cl.[6] ..... G10H 1/02

[52] U.S. Cl. ..... 84/626; 84/628; 84/658

[58] Field of Search ..... 84/628, 626, 658, 704

[56] References Cited

U.S. PATENT DOCUMENTS 3,624,584 11/1971 Ohno ..... 84/628 X
4,347,772 9/1982 Nishimoto ..... 84/628
4,524,668 6/1985 Tomisawa et al. ..... 84/627
4,558,624 12/1985 Tomisawa et al. ..... 84/626
4,700,605 10/1987 Minamitaka ..... 84/658

FOREIGN PATENT DOCUMENTS 61-132998 11/1984 Japan .
60-49394 3/1985 Japan .
62-85294 4/1987 Japan .

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic musical instrument having portamento function comprises playing keys, a musical tone signal generating device, a key depression detection device, and a control device. The key depression detection device detects a displacement of a depressed key. The control device, when a new key depression occurs following a previous key depression, controls, a tone pitch of the musical tone signal generated by the musical tone generation device to change continuously from a tone pitch of the previously depressed key to a tone pitch of the new depressed key in response to displacement of the new depressed key.

20 Claims, 6 Drawing Sheets

ELECTRONIC MUSICAL INSTRUMENT WITH PORTAMENTO FUNCTION

This is a continuation of application Ser. No. 07/657,158, filed on Feb. 15, 1991, now abandoned.

BACKGROUND OF THE INVENTION

1. Field of the Invention

This invention relates to an electronic musical instrument capable of performing portamento.

2. Description of the Prior Art

Perfect portamento for electronic musical instruments is generally considered a function which continuously changes the tone pitch of a musical tone to be generated from the tone pitch specified by a previously depressed key to the tone pitch specified by the presently depressed key. For example, such perfect portamento is shown on the line A of FIG. 2.

In order to perform portamento in prior art electronic musical instruments, in addition to a keyboard, a portamento bar, for example, has been used. So as to perform the portamento, a player slides his finger on the portamento bar and, before the tone pitch of the musical tone generated by the portamento bar reaches a final tone pitch, switches his finger from the portamento bar to a key of the keyboard corresponding to the final tone pitch. Thereby, the player tries to perform the perfect portamento.

However, since it is necessary to play so that the tone pitches of generated musical tones are smoothly changed in the time it takes to shift from the portamento bar to the keyboard, the execution of this kind of playing is very difficult.

Furthermore, in the case of performing portamento only by a keyboard without the portamento bar, at least two different keys need to be depressed before the portamento is performed. That is, since the initial and final tone pitches must be determined, the problem is that the portamento starts only after the second key depression has almost been finished as shown on the line B of FIG. 2. Since the portamento in which the tone pitch continuously changes starts after the tone pitches of the previously depressed key and the presently depressed key (2nd key operation) are determined, a delay occurs between the second key depression and the actual sound generation corresponding to it, resulting in unnatural playing.

SUMMARY OF THE INVENTION

The first object of the present invention is to perform natural portamento between the start and end of a key's depression when that key has been depressed following the depression of another key.

The second object of the present invention is to facilitate portamento performance for electronic musical instruments in which a portamento bar is difficult to install.

The third object of the present invention is to accurately and automatically change the tone pitch into the tone pitch of the presently depressed key at the end of portamento performance.

The present invention is configured so that the pitch of the musical tone signal generated by a musical tone generation device can be successively changed from the tone pitch of the previously depressed key to the tone pitch of the presently depressed key in accordance with the key depth (displacement value) of the presently depressed key. In the present invention, by depressing a second key, portamento is performed between the start and end of that key's depression.

DETAILED DESCRIPTION OF THE PREFERRED EMBODIMENTS

Figure 1:
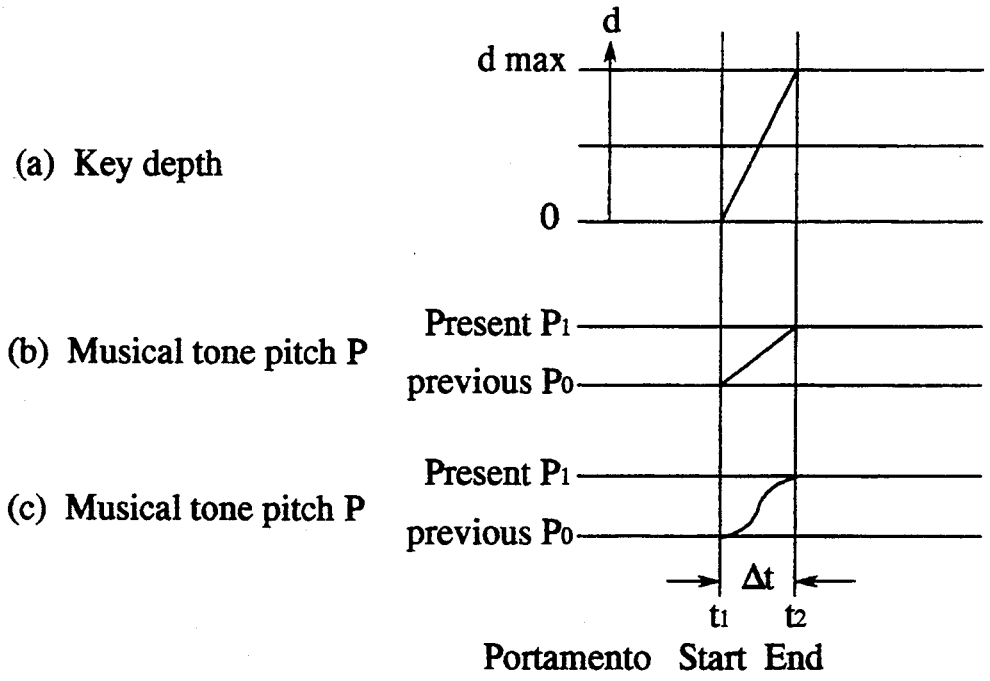
FIG. 1 shows the operating principle of the electronic keyboard instrument according to the present invention.
Figure 2:
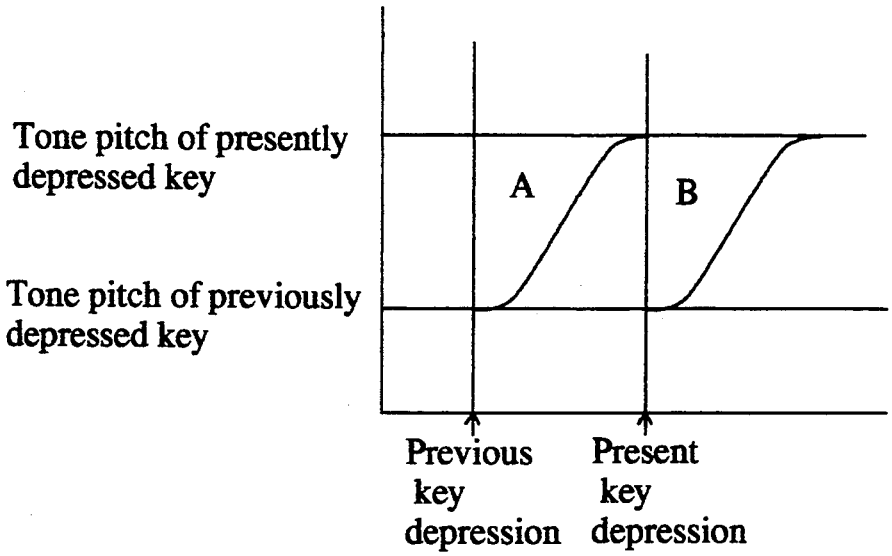
FIG. 2 is a diagram for explaining portamento for an electronic musical instrument.

FIG. 1 shows the operating principle of the present invention. (*a*) of FIG. 1. shows a key depth (displacement value) of a depressed key. The key depth d increases from 0, corresponding to the state that the key has not been depressed, to dmax, corresponding to the maximum key depth of the depressed key.

When a slight depression of a key or contact between the player's finger and the key is detected, since tone pitch $P_1$ of the presently depressed key shown in (*b*) or (*c*) of FIG. 1 is determined, the range of change in the tone pitch, which, with portamento, should move from tone pitch $P_0$ of the previously depressed key to $P_1$, is also determined.

The slightly depressed state of the above key can be detected by a means for detecting the key depth. A concrete example of this detection is as follows. A Hall effect element or a magnetoresistive effect element is fixed in a location facing a magnet installed beneath each key. The slightly depressed state and other depressed states of a key can be detected by using the output of these elements corresponding to the depth of the key's depression.

Contact between a player's finger and a key can also be detected by the output of a contact sensor installed in the key.

$\Delta t$ is the time between time $t_1$ at which the slight depression of a key or contact between the player's finger and the key is detected and time $t_2$ at which the key has been depressed to its maximum depth dmax. Within this time interval, the tone pitch moves from $P_0$ to $P_1$. In other words, at the moment the player's finger makes contact with a key, the tone pitch equivalent to the previously depressed key remains unchanged, and at the presently depressed key's maximum depth, i.e., at the maximum key depth dmax, this key's tone pitch becomes $P_1$.

Drawing (*b*) of FIG. 1 shows a case of linearly changing the tone pitch of the musical tone from the tone pitch $P_1$ of the previously depressed key to the tone pitch $P_2$ of the presently depressed key in proportion to the key depth of the presently depressed key. This change in the pitch of the musical tone can be determined by formula (1) below; therefore, the pitch P(t) of the musical tone at each time t can be solved by simple calculations using a microcomputer, etc.

$$(1)\ P(t)=P_0+(P_1-P_0)\times d/dmax$$

Drawing (c) of FIG. 1 shows an S-shaped change in the pitch of the musical tone for obtaining a more natural portamento. The pitch of the musical tone can be determined by converting the result P (t) calculated based on above formula (1) according to a preset conversion table.

The time to move the pitch of the musical tone from $P_0$ of the previously depressed key to $P_1$ of the presently depressed key can be a pre-determined fixed time shorter than the above time Δt. As shown in FIG. 1, however, it is preferable that this time be equal to the time required to depress a key from a key depth of 0 to the maximum key depth d max.

To do that, for example, a pair of switches, which turn on successively at different key depths immediately after a key has been operated, can be used. In such a case known, key velocity detection means can be used to detect the key depression velocity at the beginning of the key depression based on the time difference between ON time of the switches. Therefore, the pitch change velocity (portamento velocity) of the musical tone can be controlled in accordance with the key depression velocity.

Figure 3:
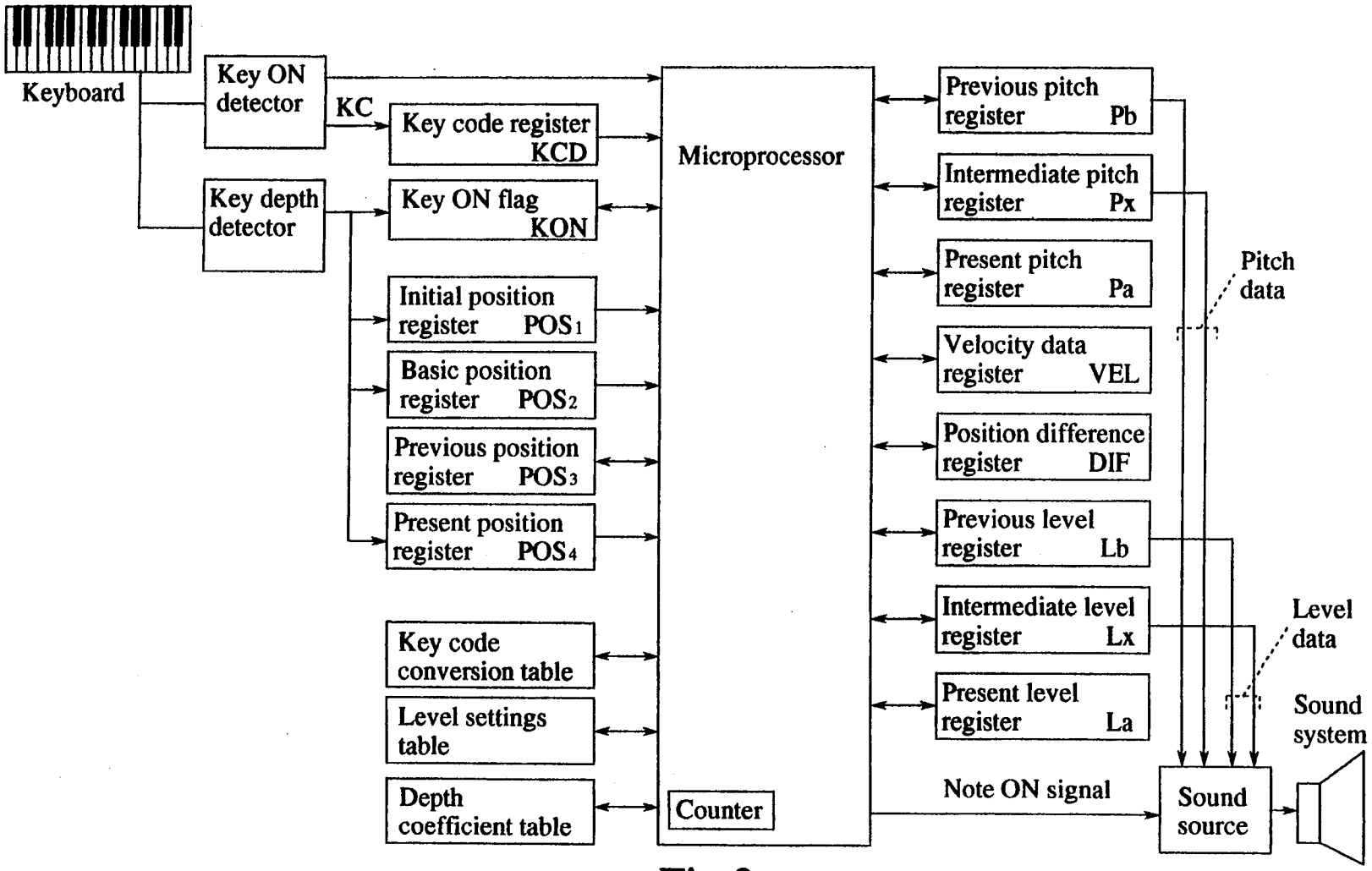
FIG. 3 is a block diagram showing the constitution of the electronic keyboard instrument according to the present invention.

FIG. 3 explains an embodiment according to the present invention and mainly shows an example of the functional relationships between each register. This embodiment changes not only the pitch of a musical tone signal generated from the sound source but also the volume level of the musical tone according to the same formula (1) corresponding to the depth of the depressed key.

A monophonic electronic musical instrument is shown in this embodiment. In this embodiment, only when a second key is depressed while one key is being depressed (legato playing), portamento, which continuously changes with the pitch of the musical tone from the tone pitch of the previously depressed key (the one key) to the tone pitch of the second depressed key, is performed.

Any of the registers, tables, and flags shown in FIG. 3 can be set to certain areas of the microprocessor's main memory. Needless to say, means of detecting a key operation and key depth can also be configured as portions of the above mentioned microprocessor's processing function. Pitch and level data directed to the sound source is shown directly supplied from pitch and level data registers, although these are actually configured as being supplied from the microprocessor's internal bus.

Referring to FIGS. 4 through 7, the operation of the above embodiment is explained below.

Figure 4:
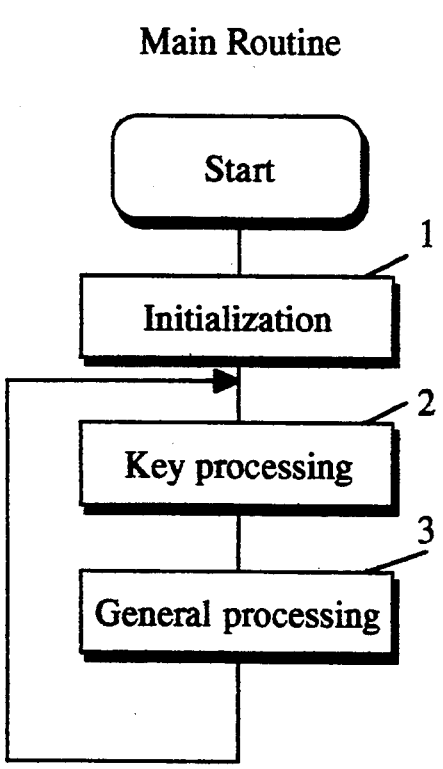
FIGS. 4, 5, 6A, 6B and 7 are flow charts showing the operations of the electronic keyboard instrument in FIG. 3.
Figure 5:
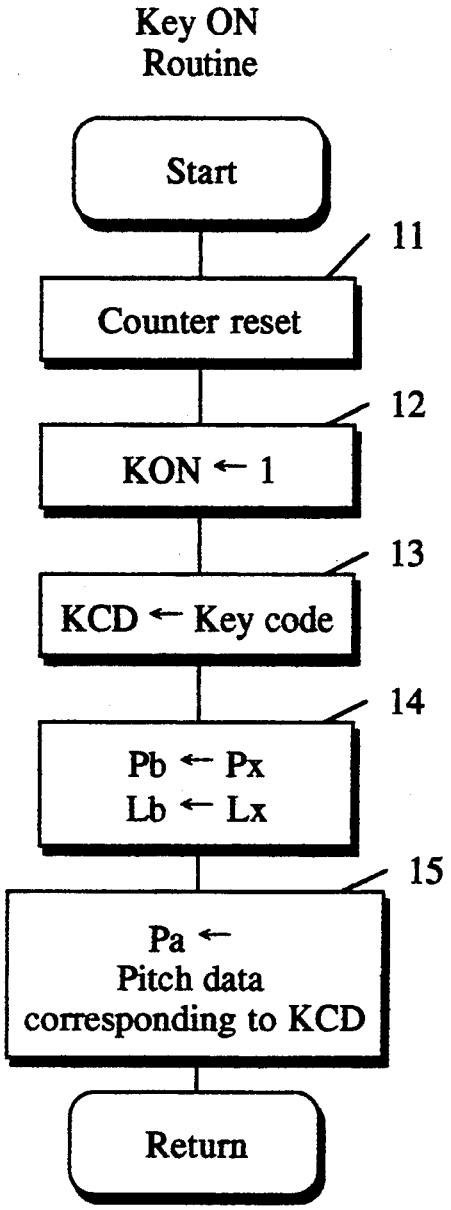
Figure 6:
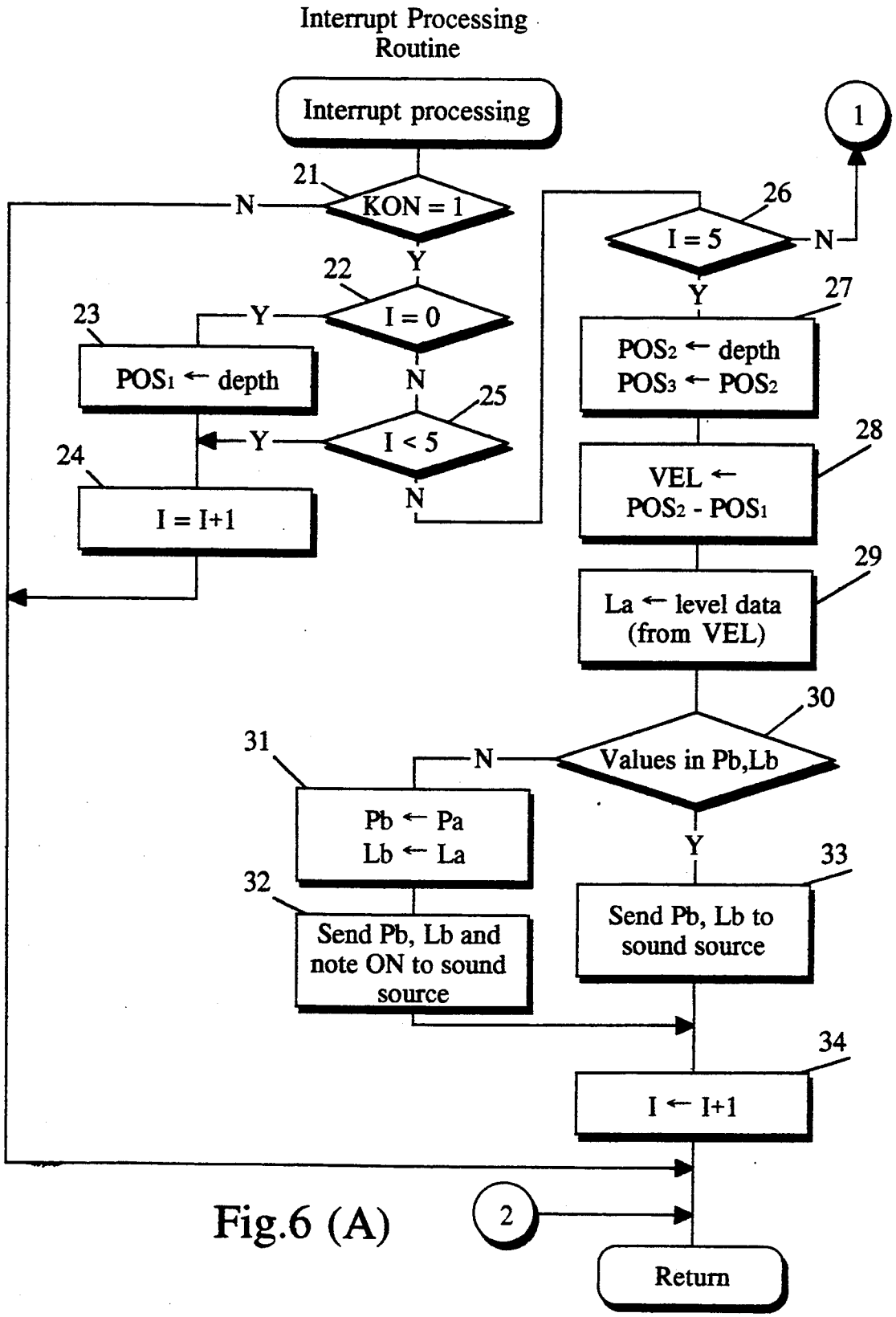
Figure 6:
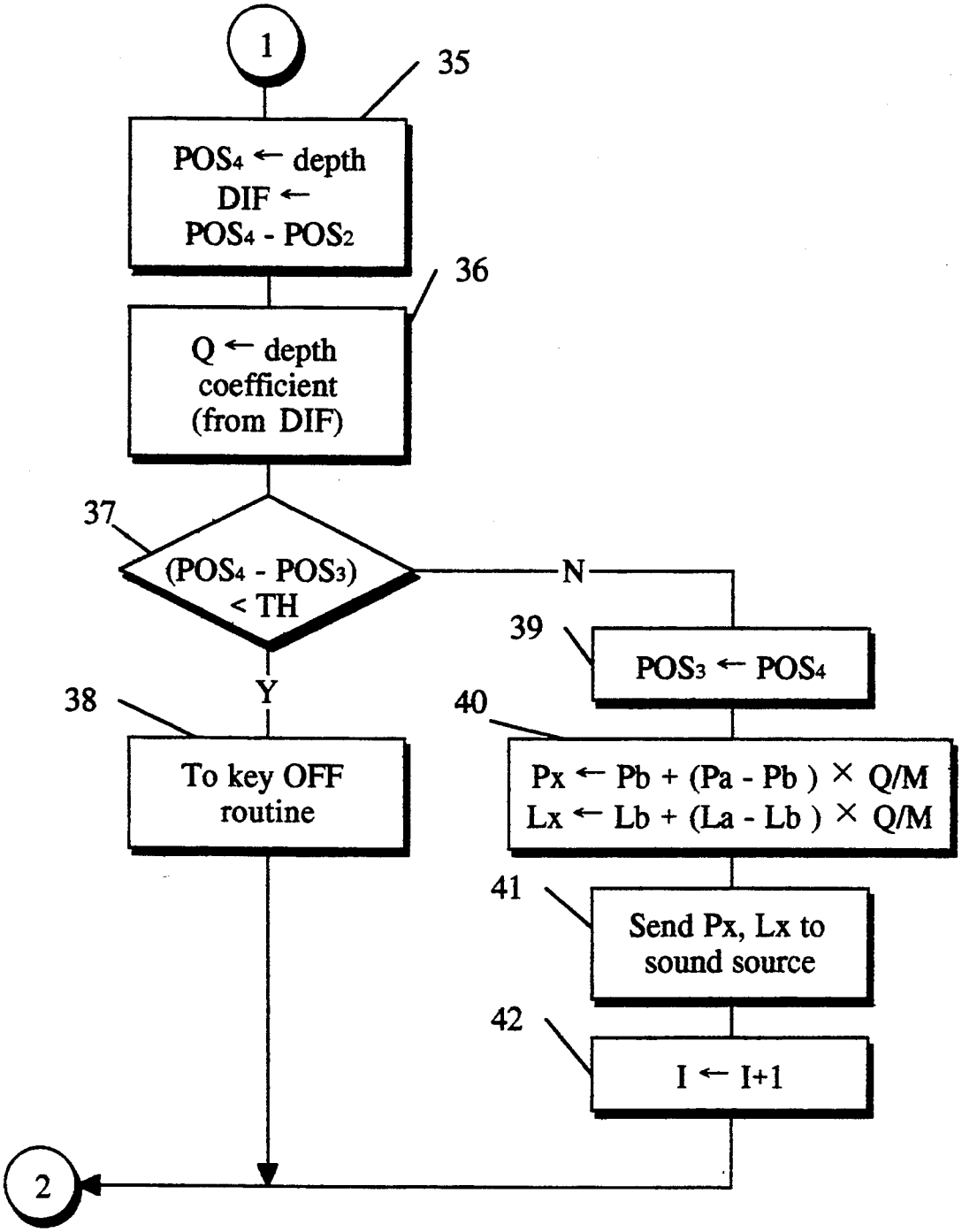

FIG. 4 shows the main routine in which the following steps are executed. In step 1, when power is applied, all the device's registers are initialized according to the main routine. Next, in step 2, key processing shown in FIG. 5 is executed. When this processing is completed, in Step 3, general processing, such as panel operation processing and tone color control processing are executed, after which, key processing in the above step 2 returns. Steps 2 and 3 are repeated until the power is turned OFF.

In step 2 of the above main routine, whether or not a key is ON is checked by means of "key ON" detection. If a key is not ON, processing moves to the general processing in step 3. If, however, there is a key ON event (new key ON), the key ON routine shown in FIG. 5 is executed.

The following steps are executed in the key ON routine shown in FIG. 5. In step 11, a counter is reset and the I value is set to "0". In step 12, a key ON flag KON is set to "1". At the same time, the newly keyed ON key code KC is stored in a key code register KCD in step 13.

In step 14, by the portamento processing in the present invention, the presently generated pitch (tone pitch) of the musical tone stored in an intermediate pitch data register Px and the presently generated level (strong) of the musical tone stored in an intermediate level data register Lx are moved to a previous pitch data register Pb and a previous level data register Lb, respectively. Since data is not stored in the Px and Lx registers in the initial key 0N condition, data stored in the Pb and Lb registers is set to "0".

In step 15, pitch data corresponding to the KC stored in the previously mentioned KCD is searched, for example, by a key code conversion table, and stored in a present pitch data register Pa. This key ON routine is completed and processing is moved to the general processing in step 3 of the main routine shown in FIG. 4.

FIG. 6(A) and 6(B) are flow charts showing interrupt processing executed by interrupts at fixed times according to a timer. In the initial step 21, the KON flag set in the above key ON routine is checked. The key is not turned ON if the KON flag is not set, and processing is immediately terminated and the main routine returns.

If, however, the KON flag is set to "1", the counter is then checked in step 22. If the counter's I value is "0", since this is the first processing cycle after the key is turned ON, in step 23, the key depth (displacement value) of the key detected by means of key depth detection is stored in an initial position register $POS_1$, i.e., the key depth is stored as the initial value. In step 24, main routine key processing returns once "1" has been added to the counter value.

If the counter value is not "0" in step 22 above, whether or not the counter value is less than "5" is checked in step 25. If the counter value is less than "5", processing moves to step 24 above and the main routine returns after "1" is added to the counter's I value. If this counter's I value is greater than or equal to "5", whether or not the counter's I value is equal to "5" is checked in step 26.

If the counter value is equal to "5", in step 27, the key depth (displacement value) indicated by the KC stored in the KCD detected by means of key depth detection is stored in a basic position register $POS_2$. At the same time, this key depth is stored in a previous position register $POS_3$. In step 28, by subtracting the $POS_1$ register value from the previously mentioned $POS_2$ register value, the key depression velocity is searched and stored in a velocity data register VEL.

Since this key depression velocity is used to control the volume of the musical tone, in step 29, by referencing the level settings table using the velocity stored in the VEL register, level data is searched and stored in a present level data register La.

In step 30, whether or not data exists in the Pb and Lb registers is checked. In the initial processing cycle, however, since values are not stored in these registers, in step 31, pitch data stored in the Pa register in the key 0N routine in step 15 of FIG. 5 is stored in the Pb register. Further, level data stored in the La register is stored in the Lb register in step 29 above.

In step 32, when this pitch and level data is sent to a sound source, a note ON signal is supplied to the sound source and a musical tone signal in which the pitch and volume level are set according to the above pitch and level data is generated.

In step 30, if values are stored in the Lb and Pb registers when the existence of data in the Pb and Lb registers is checked, pitch and level data stored in the Lb and Pb registers is sent to the sound source, just as in step 32 above. At this time, sound is generated according to this data since the note ON signal has already been supplied to the sound source.

When the supply of data to the sound source in step 32 or step 33 is completed, in step 34, the previously mentioned main routine returns after "1" has been added to the counter's I value.

If the results of steps 22, 25, and 26 above are all "No", i.e., if the counter's I value is equal to or greater than "6", processing moves to step 35. In this step, the key depth (displacement value) from the key depth detection circuit, i.e., the key's present depth indicated by the KC in the KCD, is stored in the present position register $POS_4$. The position difference is found by subtracting the basic position value stored in the $POS_2$ register from that key depth, and this difference is stored in a position difference register DIF. In step 36, the depth coefficient table is referenced based on the position difference and the depth coefficient Q is searched.

In step 37, the change in the key depth (displacement value) is found between the times of the previous and present processing. This is executed by subtracting the $POS_3$ register value set when the counter value is "5" in step 27, or at step 39 following step 37 in the previous interrupt processing, i.e., the key's previous depth, from the key's present depth stored in the $POS_4$ register.

If this change in the key depth (displacement value) is less than the threshold value previously determined at the key OFF condition, since the key is turned OFF, processing moves to the key OFF routine in step 38. When this routine is completed, the main routine returns. The threshold value is a negative value or "0".

If the above change is greater than the threshold value, in step 39, as was previously mentioned, the $POS_3$ register value is updated to the key's present depth stored in the $POS_4$ register. In step 40, the intermediate pitch Px and intermediate level Lx equivalent to the previously mentioned formula (1) are found using the 2 formulas shown in the block of this step (step 40) and stored in the Px and Lx registers, respectively.

In step 41, these values are sent to the sound source and the musical tone of the pitch and level determined by the pitch Px and level Lx is generated. In step 42, the main routine shown in FIG. 4 returns once "1" has been added to the counter.

Figure 7:
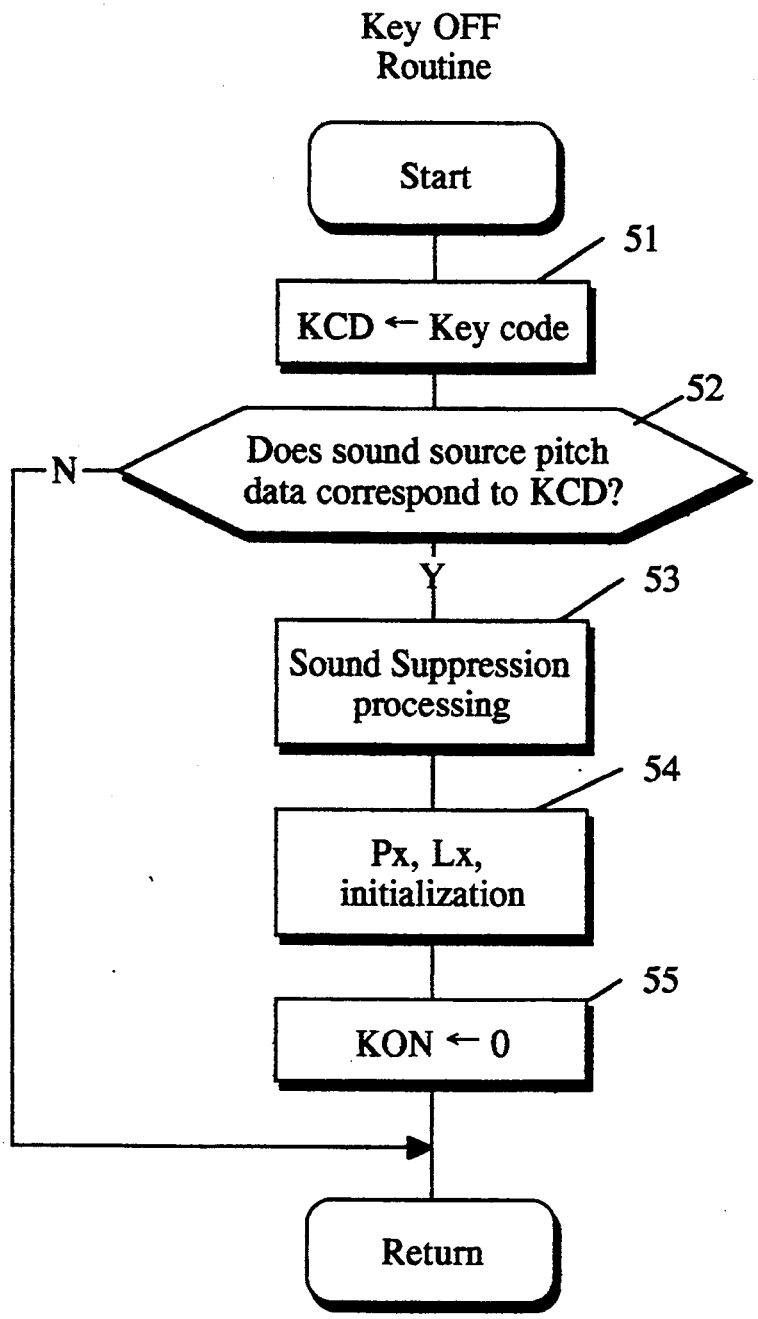

FIG. 7 is a flow chart of the key OFF routine shown in step 38 of FIG. 6(B). In step 51, the key code of the key that has been turned OFF is stored in the KCD. In step 52, whether or not the pitch data supplied to the sound source is in accordance with the key which has been turned OFF, namely, the key stored in the above KCD is checked. If the data is not in accordance with this key, the main routine returns.

If, however, the pitch data supplied to the sound source is judged in step 52 to be in accordance with the key which has been turned OFF, in step 53, sound suppression processing to stop sound from being generated from the sound source is executed. In step 54, data initialization is executed to clear data stored in the Px and Lx registers, the KON flag is reset, and processing returns to step 2 of the main routine shown in FIG. 4.

For ease of understanding, the present invention has been explained by an example using monotone sound generation. Polyphonic musical tones can also be configured to be generated simultaneously. Further, although pitch and level of a musical tone are both changed by the same method, it is clear that they can be controlled independently.

Furthermore, a means of detecting a key's depression to its maximum depth has been added. When this maximum is detected, the pitch of the musical tone can be made to become that key's tone pitch.

In the above embodiment, portamento is performed only when a key is depressed while another key is being depressed. When a key is depressed independently, the tone pitch of the depressed key is generated as soon as the key is depressed. Therefore, it is possible to provide natural portamento performance between the start and the end of the key's depression and to provide normal playing which generates a tone pitch of the key while it is being pressed.

According to the present invention, portamento can be performed in electronic musical instruments in which it is difficult to install additional operational parts such as a portamento bar, for example, electronic wind instruments. Furthermore, since the pitch accurately and automatically moves to the tone pitch determined by the key depressed at the completion of portamento, a particular advantage results in that the continuity of the musical tone can be maintained.

Furthermore, since portamento can be performed as described above using only key operations even in electronic musical instruments with such additional operational parts as wheels in synthesizers and portamento bars, playing can be easily executed.

What is claimed is:

1. An electronic musical instrument with portamento function comprising:

a plurality of keys capable of being depressed by a performer and each key designating a tone pitch of a musical tone to be generated;

a musical tone signal generator which generates musical tone signals;

a key depression detector which detects a depression displacement amount of a depressed key;

a controller, responsive to said key depression detector and to a depression of a second depressed key while a first depressed key, which is depressed before the second depressed key is depressed, is still depressed, to control the musical tone signal generator to generate a musical tone signal having a pitch which changes from a pitch designated by the first depressed key to a pitch determined in accordance with a present depression displacement amount of the second depressed key.

2. The electronic musical instrument according to claim 1 wherein:

the present depression displacement amount of the second depressed key is represented by a value d;

a maximum displacement amount for the second depressed key is represented by a value $d_{max}$;

depression of the first depressed key causes the musical tone generator to generate a musical tone signal having a pitch $P_0$;

depression of the second depressed key, while no other key is depressed, causes the musical tone generator to generate a musical tone signal having a pitch $P_1$; and the controller, in response to the depression of the second depressed key while the first depressed key is still depressed, controls the musical tone signal generator to generate a musical tone signal having a pitch proportional to $P_0+(P_1-P_0)x\ d/d_{max}$.

3. The electronic musical instrument according to claim 1 wherein said controller continuously changes a volume level of the musical tone signal from a volume level corresponding to the first depressed key to a volume level corresponding to the second depressed key in accordance with the present depression displacement amount of the second depressed key.

4. The electronic musical instrument according to claim 1 wherein said controller continuously changes the tone pitch of the musical tone signal while the present depression displacement amount of the second depressed key changes from zero to a maximum value.

5. The electronic musical instrument according to claim 4, wherein said controller continuously changes the tone pitch of the musical tone signal in a linear fashion.

6. The electronic musical instrument according to claim 4, wherein said controller continuously changes the tone pitch of the musical tone signal in a nonlinear fashion.

7. The electronic musical instrument according to claim 1 wherein said key depression detector includes a Hall effect element.

8. The electronic musical instrument according to claim 1 wherein said key depression detector includes a magnetoresistive effect element.

9. An electronic musical instrument with portamento function comprising:

a plurality of keys capable of being depressed by a performer and each key designating a tone pitch of a musical tone to be generated;

musical tone signal generation means responsive to depression of each of the plurality of keys for generating a musical tone signal;

key depression detecting means for detecting a depression displacement amount of each of the plurality of keys; and control means, responsive to a depression of a second depressed key while a first depressed key, which is depressed before the second depressed key is depressed, is still depressed, for continuously changing a tone pitch of the musical tone signal corresponding to the first depressed key to a tone pitch determined in accordance with a present depression displacement amount of the second depressed key.

10. The electronic musical instrument according to claim 9 wherein:

the present depression displacement amount of the second depressed key is represented by a value d;

a maximum displacement amount for the second depressed key is represented by a value $d_{max}$;

depression of the first depressed key causes the musical tone signal generation means to generate a musical tone signal having a pitch $P_0$;

depression of the second depressed key, while no other key is depressed, causes the musical tone signal generation means to generate a musical tone signal having a pitch $P_1$; and the control means, in response to the depression of the second depressed key while the first depressed key is still depressed, causes the musical tone signal generation means to generate a musical tone signal having a pitch proportional to $P_0+(P_1-P_0)x\ d/d_{max}$.

11. The electronic musical instrument according to claim 9 wherein said control means continuously changes a volume level of the musical tone signal from a volume level corresponding to the first depressed key to a volume level corresponding to the second depressed key in accordance with the present depression displacement amount of the second depressed key.

12. The electronic musical instrument according to claim 9 wherein said control means continuously changes the tone pitch of the musical tone signal while the present depression displacement amount of the second depressed key changes from zero to a maximum value.

13. The electronic musical instrument according to claim 12 wherein said control means continuously changes the tone pitch of the musical tone signal in a linear fashion.

14. The electronic musical instrument according to claim 12, wherein said control means continuously changes the tone pitch of the musical tone signal in a nonlinear fashion.

15. The electronic musical instrument according to claim 9 wherein said control means controls a volume level of the musical tone signal from a volume level corresponding to the first depressed key to a volume level corresponding to the second depressed key in accordance with a current key depression velocity of the second depressed key.

16. The electronic musical instrument according to claim 15 wherein said control means iteratively monitors the current key depression velocity of the second depressed key to continuously control the volume level corresponding to the second depressed key.

17. A method for generating a portamento effect in an electronic musical instrument having a sound source to generate at least one tone and an iterative processor receiving key on and key off information, key pitch information relating to pitch of tones associated with each of the key on information, key depth of depression information, ranging from zero to a maximum value, associated with each of the key on information, the method producing a portamento effect of an iterative change in pitch of the tone generated by the sound source from a first pitch corresponding to the key pitch information relating to a first key on information to an intermediate pitch determined by (i) the key pitch information relating to a second key on information and (ii) the key depth of depression information associated with the second key on information, the method comprising:

storing the key depth of depression information at least three different times while the second key on information is present;

generating at least two successive depth data based upon different stored key depth depression information;

iteratively generating intermediate pitch information based upon the first and second pitch information and the successive depth data; and generating with the tone generator an intermediate tone based upon the intermediate pitch information, the pitch of said intermediate tone reaching the pitch associated with the second key on information only if the key depth of depression information associated with the second key on information is at said maximum value.

18. The method of claim 17 wherein the generated intermediate tone is generated at a volume level and the method further includes altering the level of the intermediate tone being generated based upon the successive depth data.

19. An electronic musical instrument having an iterative processor performing various processes in iterations, a plurality of keying means providing key on and key off information with respectively an activation and deactivation of each keying means, pitch information related to each of the key on information, and depth of depression information, ranging from zero to a maximum value, for each keying means between each key on and key off information, and a tone generator responsive to the processor, the processor programmatically and iteratively:

determining that a second keying means has been activated while a first keying means remains activated;

providing varying intermediate pitch information over a plurality of iterations from the pitch information related to the first keying means to the pitch information related to the second keying means, the intermediate pitch information for a plurality of the iterations varying with the depth of depression information for the second key and reaching the pitch information related to the second keying means only if the depth of depression information for the second keying means reaches said maximum value; and providing the intermediate pitch information to the tone generator to generate a tone.

20. The electronic musical instrument of claim 19 wherein the generated tone is generated at a volume level and the depth of depression information for the second keying means controls said volume level.

* * * * *